US011651740B2

(12) United States Patent
Kim et al.

(10) Patent No.: US 11,651,740 B2
(45) Date of Patent: May 16, 2023

(54) DISPLAY DEVICE AND COMPENSATION METHOD THEREOF

(71) Applicant: LG Display Co., Ltd., Seoul (KR)

(72) Inventors: Minsu Kim, Paju-si (KR); Ahram Nam, Paju-si (KR); Donghoon Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/544,198

(22) Filed: Dec. 7, 2021

(65) Prior Publication Data

US 2022/0208106 A1 Jun. 30, 2022

(30) Foreign Application Priority Data

Dec. 31, 2020 (KR) ..... 10-2020-0189303

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2310/061* (2013.01); *G09G 2310/08* (2013.01); *G09G 2320/0233* (2013.01); *G09G 2340/0435* (2013.01)

(58) Field of Classification Search
None
See application file for complete search history.

(56) References Cited

U.S. PATENT DOCUMENTS

2015/0379940 A1 12/2015 Kishi
2017/0162113 A1 6/2017 Lin et al.
2019/0014292 A1 1/2019 Ishii
(Continued)

FOREIGN PATENT DOCUMENTS

CN 206210357 U 5/2017
JP 2019-015794 A 1/2019
(Continued)

OTHER PUBLICATIONS

Extended European Search Report dated May 11, 2022, issued in corresponding European Patent Application No. 21217752.1.
(Continued)

*Primary Examiner* — Nitin Patel
*Assistant Examiner* — Amen W Bogale
(74) *Attorney, Agent, or Firm* — Morgan, Lewis & Bockius LLP

(57) ABSTRACT

A display device may include: a display panel with subpixels connected respectively to scan lines, sensing lines, and data lines; a gate driver configured to supply a scan signal to the scan lines during an active period and to supply a sensing signal to the sensing lines during a sensing period of a blank period; a data driver configured to supply a data voltage to the data lines; and a timing controller configured to control the gate and data drivers. The timing controller may determine the active period, blank period, and sensing period to be, respectively: a first active period, a first blank period, and a first sensing period for operating at the first frame rate; and a second active period, a second blank period, and a second sensing period for operating at the second frame rate. The first sensing period and the second sensing period have a same length.

14 Claims, 12 Drawing Sheets

(56) References Cited

U.S. PATENT DOCUMENTS

| | | | | |
|---|---|---|---|---|
| 2019/0378459 | A1* | 12/2019 | Kim | G09G 3/3291 |
| 2020/0043421 | A1 | 2/2020 | Kang et al. | |
| 2020/0160794 | A1 | 5/2020 | Park | |
| 2021/0225277 | A1 | 7/2021 | Xu et al. | |
| 2022/0139333 | A1* | 5/2022 | Jin | G09G 3/3233 345/214 |

FOREIGN PATENT DOCUMENTS

| | | | |
|---|---|---|---|
| JP | 2020-024413 | A | 2/2020 |
| JP | 2020-519918 | A | 7/2020 |
| KR | 10-2016-0022957 | A | 3/2016 |
| KR | 10-2020-0058943 | A | 5/2020 |
| KR | 10-2020-0080783 | A | 7/2020 |
| WO | 2014/141958 | A1 | 9/2014 |

OTHER PUBLICATIONS

Office Action dated Nov. 29, 2022, issued by the Japanese Patent Office in corresponding Japanese Patent Application No. 2021-202200.

* cited by examiner

DISPLAY DEVICE AND COMPENSATION METHOD THEREOF

CROSS REFERENCE TO RELATED APPLICATION

The present application claims the benefit of and priority to Korean Patent Application No. 10-2020-0189303, filed on Dec. 31, 2020, which is hereby incorporated by reference as if fully set forth herein.

BACKGROUND

1. Technical Field

The present disclosure relates to a display device and a compensation method thereof. More particularly, the present disclosure relates to a method of sensing a threshold voltage of a driving transistor of subpixels by changing a compensation time point in real-time when a display device is driven and relates to a display device capable of performing the method.

2. Description of the Related Art

With the advancement of information-oriented society, various types of display devices have been developed. Recently, various types of display devices, such as a liquid crystal display (LCD) device, a plasma display panel (PDP) display device, and an organic light-emitting display (OLED) device, have been utilized.

An organic light-emitting element constituting the organic light-emitting display device is self-luminous and does not require a separate light source, so that the thickness and the weight of a display device may be reduced. In addition, the organic light-emitting display device has advantageous characteristics, such as low power consumption, high luminance, and a high response rate.

Such an organic light-emitting display device may be susceptible to degradation in display quality due to the characteristics of transistors included within the organic light-emitting display device or due to the degradation of an organic light-emitting element.

SUMMARY

Accordingly, the present disclosure is directed to a display device and a compensation method thereof that substantially obviate one or more problems due to limitations and disadvantages of the related art.

Additional features and aspects will be set forth in the description that follows, and in part will be apparent from the description, or may be learned by practice of the present disclosure provided herein. Other features and aspects of the present disclosure may be realized and attained by the structure particularly pointed out in the written description, or derivable therefrom, and the claims hereof as well as the appended drawings.

To achieve these and other advantages and in accordance with the purpose of the disclosure, as embodied and broadly described herein, a display device may include: a display panel comprising a plurality of subpixels connected respectively to a plurality of scan lines, a plurality of sensing lines, and a plurality of data lines, the display panel being capable of operating at a first frame rate and at a second frame rate different from the first frame rate; a gate driver configured to supply a scan signal to the scan lines during an active period of one frame and configured to supply a sensing signal to the sensing lines during a sensing period of a blank period of the one frame; a data driver configured to supply a data voltage to the data lines; and a timing controller configured to control the gate driver and the data driver, the timing controller being configured to determine the active period, the blank period, and the sensing period to be, respectively, a first active period, a first blank period, and a first sensing period for operating the display panel at the first frame rate, and to be, respectively, a second active period, a second blank period, and a second sensing period for operating the display panel at the second frame rate, wherein the first sensing period and the second sensing period have a same length.

In some embodiments, the first frame rate may be greater than the second frame rate, and the first active period may have a same length as the second active period.

In some embodiments, the second blank period may be longer than the first blank period.

In some embodiments, an ending time of the second sensing period may be concurrent with an ending time of the second blank period.

In some embodiments, the timing controller may be configured to determine a starting time of the second sensing period by calculating backwards from an ending time of the one frame at the second frame rate by a length of the second sensing period.

In some embodiments, with a change from an operation at the first frame rate to an operation at the second frame rate, the timing controller may be configured to select at least one of the sensing lines during the second blank period, and the gate driver may be configured to supply the sensing signal to the at least one selected sensing line during the second sensing period.

In some embodiments, with a change from an operation at the first frame rate to an operation at the second frame rate, the timing controller may be configured to select two or more of the sensing lines during the second blank period, and the gate driver may be configured to supply the sensing signal to the two or more selected sensing lines sequentially during the second sensing period.

In some embodiments, the two or more selected sensing lines may be adjacent to each other on the display panel in a pixel column direction.

In some embodiments, the display device may further include a memory configured to store one or more of the first active period, the first blank period, the first sensing period, the second active period, the second blank period, and the second sensing period as parameters.

In some embodiments, the timing controller may be configured to control the gate driver and the data driver based on: the first active period, the first blank period, the first sensing period during an operation of the display panel at the first frame rate, and the second active period, the second blank period, and the second sensing period during an operation of the display panel at the second frame rate.

In some embodiments, each of the subpixels may include a driving transistor connected to a corresponding one of the sensing lines, and wherein the gate driver may be configured to supply the sensing signal to the corresponding one of the sensing lines to sense one or more of a mobility characteristic and a threshold voltage of the driving transistor.

In another aspect of the present disclosure, a compensation method for a display device comprising a display panel with a plurality of subpixels connected respectively to a plurality of scan lines, the display panel being capable of operating at a first frame rate and at a second frame rate different from the first frame rate is provided where the method may include: determining a frame rate as the first frame rate or the second frame rate based on an image data provided to the display panel; determining an active period, a blank period, and a sensing period of one frame to be, respectively, a first active period, a first blank period, and a first sensing period if the determined frame rate is the first frame rate, and to be, respectively, a second active period, a second blank period, and a second sensing period if the determined frame rate is the second frame rate, the first sensing period and the second sensing period having a same length; changing the frame rate from the first frame rate to the second frame rate; and applying a sensing signal to at least one of the sensing lines to sense at least corresponding one of the subpixels connected to the at least one of the sensing lines during the second sensing period.

In some embodiments, the first frame rate may be greater than the second frame rate, and the first active period may have a same length as the second active period.

In some embodiments, the second blank period may be longer than the first blank period.

In some embodiments, an ending time of the second sensing period may be concurrent with an ending time of the second blank period.

In some embodiments, the applying of the sensing signal may comprise: determining a starting time of the second sensing period by determining backwards from an ending time of the one frame at the second frame rate by a length of the second sensing period; and starting the second sensing period at the determined starting time.

In some embodiments, the applying of the sensing signal may comprise: selecting the at least one of the sensing lines during the second blank period; and supplying the sensing signal to the at least corresponding one of the subpixels during the second sensing period to sense one or more of a mobility characteristic and a threshold voltage of a driving transistor of the at least corresponding one of the subpixels.

In some embodiments, the applying of the sensing signal may comprise: selecting two or more of the sensing lines during the second blank period; and Supplying the sensing signal to the two or more selected sensing lines sequentially during the second sensing period to sense a characteristic value of corresponding subpixels among the plurality of subpixels connected to the two or more selected sensing lines.

In some embodiments, the two or more sensing lines may be adjacent to each other on the display panel in a pixel column direction.

In some embodiments, the display device may further comprise a memory, and one or more of the first active period, the first blank period, the first sensing period, the second active period, the second blank period, and the second sensing period may be stored as parameters in the memory.

According to example embodiments of the present disclosure, by sensing and compensating characteristic values of the driving transistor disposed in each subpixel, an image quality of the display device may be improved.

In addition, according to example embodiments of the present disclosure, by changing a real-time compensation time of the display device driven in a variable refresh rate (VRR) driving mode, the memory allocation for a data reset may be reduced.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principles of the disclosure. In the drawings.

DETAILED DESCRIPTION

Figure 1:
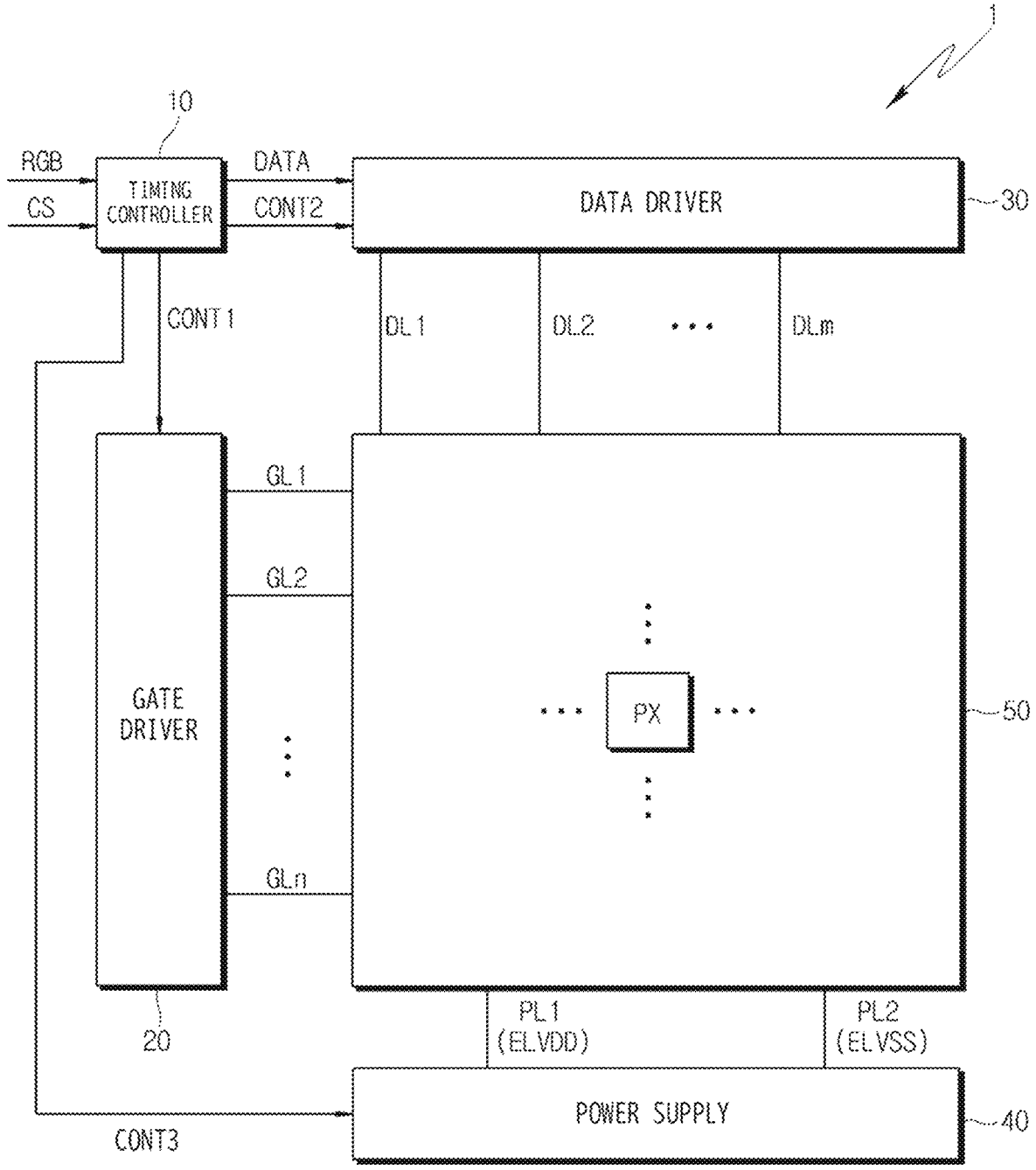
FIG. 1 is a block diagram illustrating a configuration of a display device according to an example embodiment of the present disclosure.

Reference will now be made in detail to the exemplary embodiments of the present disclosure, examples of which are illustrated in the accompanying drawings.

In this specification, when one component (or region, layer, portion) is referred to as being "on," "connected to," or "coupled to" another component, it should be understood to mean that one component may be directly or indirectly "on," "connected to," or "couple to" another component and that an intervening third component may also be present, unless otherwise specified.

Like reference numerals may refer to like elements throughout unless otherwise specified. Also, in the drawings, the thickness, ratio, and dimensions of components as specifically illustrated may be exaggerated for clarity of illustration. The term "or" or "and/or" includes one or more combinations that the associated elements may define.

Although the terms "first," "second," and the like may be used herein to describe various elements, these elements should not be limited by these terms as they are not used to define a particular order. These terms are used only to distinguish one element from another. For example, a first element could be termed a second element, and similarly, a second element could be termed a first element, without departing from the scope of the present disclosure. An element described in the singular form is intended to include a plurality of elements, and vice versa, unless the context clearly indicates otherwise.

Also, such terms as "under," "below," "above," and "upper" are used for explaining positional relationship among components illustrated in the drawings. These terms are relative concepts and may be described on the basis of the direction in the drawings.

The meaning of the term "include" or "comprise" may be followed by a property, a fixed number, a step, an operation, an element, a component or a combination thereof, but does not exclude other properties, fixed numbers, steps, operations, elements, components or combinations thereof.

FIG. 1 is a block diagram illustrating a configuration of a display device according to an example embodiment of the present disclosure.

As illustrated in FIG. 1, a display device 1 may include a timing controller 10, a gate driver 20, a data driver 30, a power supply 40, and a display panel 50.

The timing controller 10 may receive an image signal RGB and a control signal CS from an external source. The image signal RGB may include a plurality of gray scale data. The control signal CS may include, for example, a horizontal synchronization signal, a vertical synchronization signal, and a main clock signal.

The timing controller 10 may process the image signal RGB and the control signal CS to prepare the signals appropriate for an operation condition of the display panel 50, and thus may output image data DATA, a gate driving control signal CONT1, a data driving control signal CONT2, and a power supply control signal CONT3.

The gate driver 20 may be connected to pixels PX of the display panel 50 through multiple gate lines GL1 to GLn. The gate driver 20 may generate gate signals on the basis of the gate driving control signal CONT1 output from the timing controller 10. The gate driver 20 may provide the generated gate signals to the pixels PX through the multiple gate lines GL1 to GLn.

In various embodiments, the gate driver 20 may be further connected to the pixels PX of the display panel 50 through multiple second gate lines GL21 to GL2*m* (not illustrated). The gate driver 20 may provide a sensing signal to the pixels PX through the multiple second gate lines GL21 to GL2*m*. The sensing signal may be supplied so as to measure a characteristic of a driving transistor and/or a light-emitting element provided in the pixels PX.

The data driver 30 may be connected to the pixels PX of the display panel 50 through multiple data lines DL1 to DLm. The data driver 30 may generate data signals on the basis of the image data DATA and the data driving control signal CONT2 output from the timing controller 10. The data driver 30 may provide the generated data signals to the pixels PX through the multiple data lines DL1 to DLm.

In various embodiments, the data driver 30 may be further connected to the pixels PX of the display panel 50 through multiple sensing lines (or reference lines) SL1 to SLm (not illustrated). The data driver 30 may provide a reference voltage (a sensing voltage or an initialization voltage) to the pixels PX through the multiple sensing lines SL1 to SLm, or may sense states of the pixels PX on the basis of an electrical signal fed back from the pixels PX.

The power supply 40 may be connected to the pixels PX of the display panel 50 through multiple power lines PL1 and PL2. The power supply 40 may generate a driving voltage to be provided to the display panel 50, on the basis of the power supply control signal CONT3. The driving voltage may include, for example, a high-potential driving voltage ELVDD and a low-potential driving voltage ELVSS. The power supply 40 may provide the generated driving voltages ELVDD and ELVSS to the pixels PX, through the corresponding power lines PL1 and PL2.

In the display panel 50, multiple pixels PX are disposed. The pixels PX may be, for example, arranged in a matrix form on the display panel 50.

Each pixel PX may be electrically connected to the corresponding gate line and the corresponding data line. The pixels PX may emit light with luminance corresponding to the gate signals and the data signals that are supplied through the gate lines GL1 to GLn and the data lines DL1 to DLm, respectively.

In an example embodiment, each pixel PX may display any one of three colors. For example, each pixel PX may display any one of red, green, and blue colors. In another example, each pixel PX may display any one of cyan, magenta, and yellow colors. In another example embodiment, the pixels PX may be configured to display any one of four or more colors. For example, each pixel PX may display any one of red, green, blue, and white colors.

The timing controller 10, the gate driver 20, the data driver 30, and the power supply 40 may each be configured as separate integrated circuits (ICs), or two or more of them may be integrated in the same IC. For example, one or both of the data driver 30 and the power supply 40 may be configured as an integrated circuit integrated with the timing controller 10.

In addition, in FIG. 1, the gate driver 20 and the data driver 30 are illustrated as elements separated from the display panel 50. However, one or both of the gate driver 20 and the data driver 30 may be configured in an in-panel manner and be formed integrally with the display panel 50. For example, the gate driver 20 may be formed integrally with the display panel 50 according to a gate-in-panel (GIP) manner.

Figure 2:
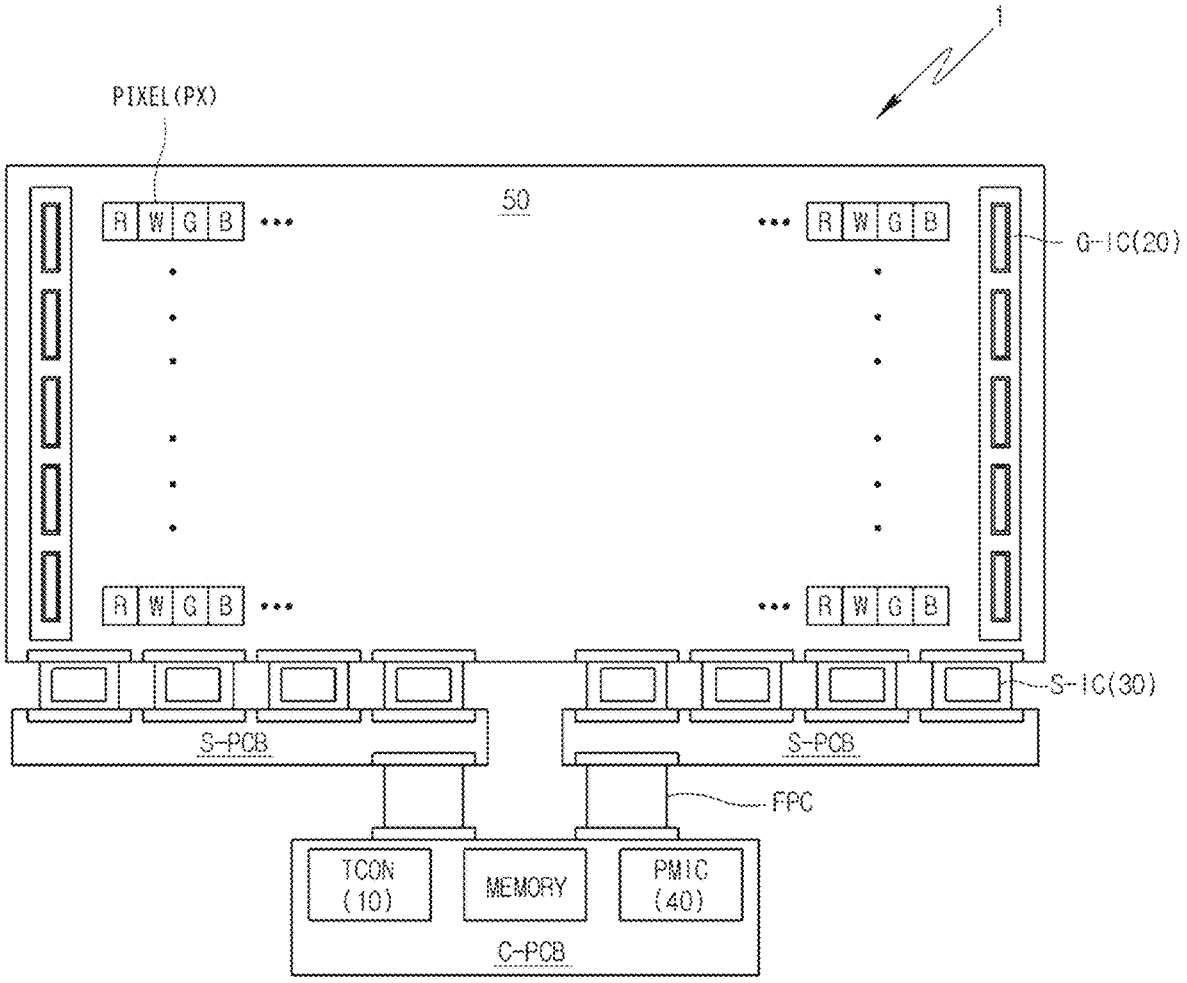
FIG. 2 is a view illustrating the display device according to an example embodiment of the present disclosure.

FIG. 2 is a view illustrating the display device according to an example embodiment of the present disclosure.

In FIG. 2, the display panel 50 in a rectangular shape is illustrated. As shown in FIG. 2, the display panel 50 may include the multiple pixels PX arranged therein in the form of columns and rows. For example, the multiple pixels PX may each include four subpixels, and the four subpixels may be a red subpixel, a white subpixel, a green subpixel, and a blue subpixel, respectively.

In addition, the display device 1 may include a gate driving IC (G-IC) 20. The display panel 50 may be implemented in a gate-in-panel (GIP) manner in which the gate driving IC 20 is disposed within the display panel 50. The gate driving IC 20 may be attached to a left side, a right side, or both the left and right sides of the display panel 50.

In addition, the display device 1 may include a data driving IC (source driving IC or S-IC) 30. The source driving IC 30 may be attached to a lower portion of the display panel 50, or multiple source driving ICs 30 may be attached in a transverse direction of the display panel 50. Such a source driving IC 30 may be implemented in a chip on film (COF) manner where it is disposed within a flexible PCB (FPCB), a chip on glass (COG) manner where it is disposed on a glass substrate constituting the display panel 50, and the like.

For example, in the example embodiment illustrated in FIG. 2, the source driving IC 30 is implemented in the COF manner, and the FPCB connects the display panel 50 and a source PCB (S-PCB) through pad connection. The source driving IC 30 may transmit a voltage (source IC driving voltage, EVDD, EVSS, VREF, etc.) provided to the display panel 50 from a control PCB (C-PCB).

The source PCB (S-PCB) may be connected to the display panel 50 from below the display panel 50 through the FPCB and may be connected to the control PCB (C-PCB) through a flexible plat cable (FPC) connection. The source PCB (S-PCB) may be directly connected to the source driving IC 30 and may transmit the gate driving control signal to the gate driving IC 20. In addition, the source PCB (S-PCB) may receive power (ELVDD, ELVSS, VGH, VHL, VREF, etc.) from the control PCB (C-PCB) and transmit it to the display panel 50. In addition, a connection between the control PCB (C-PCB) and the gate driving IC 20 may be provided through the leftmost or rightmost source driving IC 30 of the source PCB (S-PCB). For example, a gate driving IC driving voltage, a gate high voltage VGH, a gate low voltage VGL, etc., may be transmitted from the control PCB (C-PCB) to the gate driving IC 20 through the source PCB (S-PCB).

The control PCB (C-PCB) may be disposed below the display panel 50, and may be connected to the display panel 50 through the source PCB (S-PCB) and the FPC. The control PCB (C-PCB) may include the timing controller (TCON) 10, the power supply 40, and a memory. The description of the timing controller 10 and the power supply 40 is provided above with reference to FIG. 1 and is not repeated here. In addition, the control PCB (C-PCB) may calculate an algorithm for every frame of an output image data to be output, store compensation data, and include an area for storing various parameters required for the algorithm calculation or various parameters for tuning. Accordingly, a volatile memory and/or a non-volatile memory may be disposed on the control PCB (C-PCB).

Figure 3:
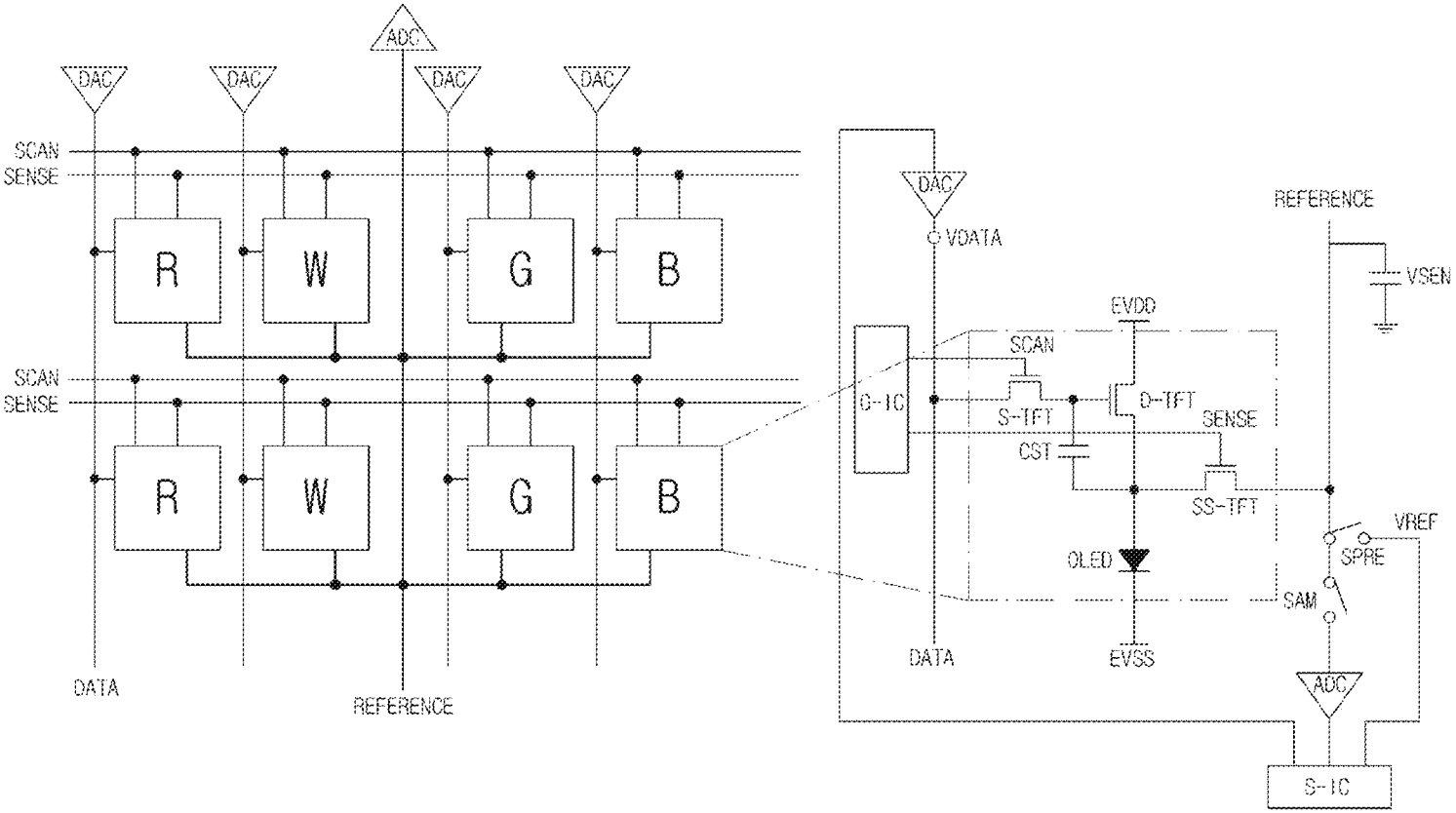
FIG. 3 is a view illustrating a structure of a pixel according to an example embodiment of the present disclosure.

FIG. 3 is a view illustrating a structure of a pixel according to an example embodiment of the present disclosure.

As illustrated in FIG. 3, one pixel may include four subpixels R, W, G, and B. Each of the subpixels may be connected to the gate driving IC (G-IC) through a scan line SCAN and a sensing line SENSE, and may be connected to the source driving IC (S-IC) through a reference line REFERENCE. Also, each subpixel may receive a data voltage VDATA from the source driving IC (S-IC) through a digital-to-analog converter (DAC). In addition, a sensing voltage VSEN output from each subpixel may be provided to the source driving IC (S-IC) through an analog-to-digital converter (ADC). Further, each subpixel may be connected to the high-potential driving voltage ELVDD and the low-potential driving voltage ELVSS.

Each subpixel may include a scan TFT (S-TFT), a driving TFT (D-TFT), and a sensing TFT (SS-TFT). In addition, each subpixel may include a storage capacitor CST and a light-emitting element OLED.

A first electrode (for example, a source electrode) of the scan transistor (S-TFT) may be connected to the data line DL. The data voltage VDATA may be output from the source driving IC (S-IC) and may be applied to the data line DL through the DAC. A second electrode (for example, a drain electrode) of the scan transistor (S-TFT) may be connected to one electrode of the storage capacitor CST and may be connected to a gate electrode of the driving TFT (D-TFT). The gate electrode of the scan transistor (S-TFT) may be connected to the scan line SCAN (or the gate line GL). That is, the scan transistor (S-TFT) may be turned on when the gate signal at a gate-on level is applied through the scan line SCAN, so that the data signal applied through the data line DL may be transmitted to one electrode of the storage capacitor CST.

One electrode of the storage capacitor CST may be connected to a third electrode (for example, a drain electrode) of the scan TFT (S-TFT). The other electrode of the storage capacitor CST may be configured to receive the high-potential driving voltage ELVDD via the driving TFT (D-TFT). The storage capacitor CST may charge a voltage corresponding to a difference between a voltage applied to one electrode thereof and the high-potential driving voltage ELVDD applied to the other electrode thereof. In addition, the storage capacitor CST may charge a voltage corresponding to a difference between the voltage applied to one electrode thereof and a reference voltage VREF applied to the other electrode thereof through a switch SPRE and the sensing TFT (SS-TFT).

A first electrode (for example, a source electrode) of the driving transistor (D-TFT) may be configured to receive the high-potential driving voltage ELVDD, and a second electrode (for example, a drain electrode) of the D-TFT may be connected to a first electrode (for example, an anode electrode) of the light-emitting element OLED. A third electrode (for example, a gate electrode) of the driving transistor (D-TFT) may be connected to one electrode of the storage capacitor CST. The driving transistor (D-TFT) may be turned on when a voltage at the gate-on level is applied, and may control an amount of a driving current flowing through the light-emitting element OLED in response to a voltage provided to the gate electrode. That is, the current may be determined by a voltage difference in the driving TFT (D-TFT) Vgs (or a storage voltage difference in the storage capacitor CST) and may be applied to the light-emitting element OLED.

A first electrode (for example, a source electrode) of the sensing TFT (SS-TFT) may be connected to the reference line REFERENCE, and a second electrode (for example, a drain electrode) of the SS-TFT may be connected to the other electrode of the storage capacitor CST. A third electrode (for example, a gate electrode) of the sensing TFT (SS-TFT) may be connected to the sensing line SENSE. That is, the sensing TFT (SS-TFT) may be turned on by a sensing signal output from the gate driving IC (G-IC) and may apply the reference voltage VREF to the other electrode of the storage capacitor CST. If both the switch SPRE and another switch SAM are turned off and the sensing TFT (SS-TFT) is turned on, the storage voltage of the storage capacitor CST may be transmitted to the capacitor connected to the reference line REFERENCE, and the sensing voltage VSEN may be stored in the reference line capacitor.

If the switch SPRE is turned off and another switch SAM is turned on, the voltage VSEN stored in the reference line capacitor may be output to the source driving IC (S-IC) through the ADC. This output voltage may be used as a voltage for sensing and sampling a degradation of a corresponding subpixel. That is, a voltage for compensating for a corresponding subpixel may be sensed and sampled. Specifically, the characteristics of the driving TFT (D-TFT) may be classified into two types—the mobility and threshold voltage. The compensation may be implemented by sensing the mobility and threshold voltage of the driving TFT (D-TFT). In addition, the characteristics of the corresponding subpixel may also be determined by the degradation of the light-emitting element OLED, and it may be useful to sense and compensate for the degree of degradation of the light-emitting element OLED. Hereinafter, a real-time (RT) compensation method will be described. The real-time compensation method is a method in which the mobility and the threshold voltage of the driving TFT (D-TFT) may be compensated in real-time while the display device 1 is powered on and outputs the image data.

The light-emitting element may output light corresponding to the driving current. The light-emitting element may output light corresponding to any one of red, white, green, and blue colors. The light-emitting element may be an organic light-emitting diode (OLED) or an ultra-small inorganic light-emitting diode having a size in a micro to nanoscale range, but the present disclosure is not limited thereto. Hereinafter, the technical concepts of the present disclosure will be described with reference to an example embodiment in which the light-emitting element is formed of an organic light-emitting diode (OLED).

FIG. 3 illustrates an example in which a switching transistor ST, the driving transistor D-TFT, and the sensing transistor SS-TFT are NMOS transistors. However, the present disclosure is not limited thereto. For example, at least some or all of the transistors constituting each pixel PX may be constructed as a PMOS transistor. In various embodiments, each of the switching transistor ST and the driving transistor D-TFT may be implemented as a low-temperature polycrystalline silicon (LTPS) thin-film transistor, an oxide thin-film transistor, or a low-temperature polycrystalline oxide (LTPO) thin-film transistor.

In addition, in the example illustrated in FIG. 3, four subpixels share one reference line REFERENCE. However, the present disclosure is not limited thereto. A different number of subpixels may share one reference line REFERENCE, or each subpixel may be connected to a separate corresponding reference line REFERENCE. In the present specification, for convenience of description, FIG. 3 illustrates an example in which four subpixels share one reference line REFERENCE. Thus, the FIG. 3 configuration should be considered as an example.

FIGS. 4 to 8 are views illustrating an example compensation for a mobility characteristic while the display device according to an example embodiment of the present disclosure is driven. That is, the compensation in the present description may be a compensation that is performed while the display device is powered on and the image data is being output. In addition, the compensation in the present description may correspond to a compensation for correcting a deviation by sensing the mobility characteristic of the driving TFT (D-TFT).

The sensing of the mobility characteristic during the driving of the display device may be performed in a blank period between one frame and the next frame. In the example configuration in which four subpixels share one reference line, it may be preferable that the sensing of the four subpixels is not simultaneously performed. In addition, in such an example configuration, it may be preferable that subpixels having one color among the subpixels connected to any gate line are sensed in a blank period and subpixels having other colors among the subpixels connected to the gate line are sensed in the subsequent blank period or periods. This is because it may not be preferable to sense all the subpixels connected to the gate line since the blank period may be short.

Figure 4:
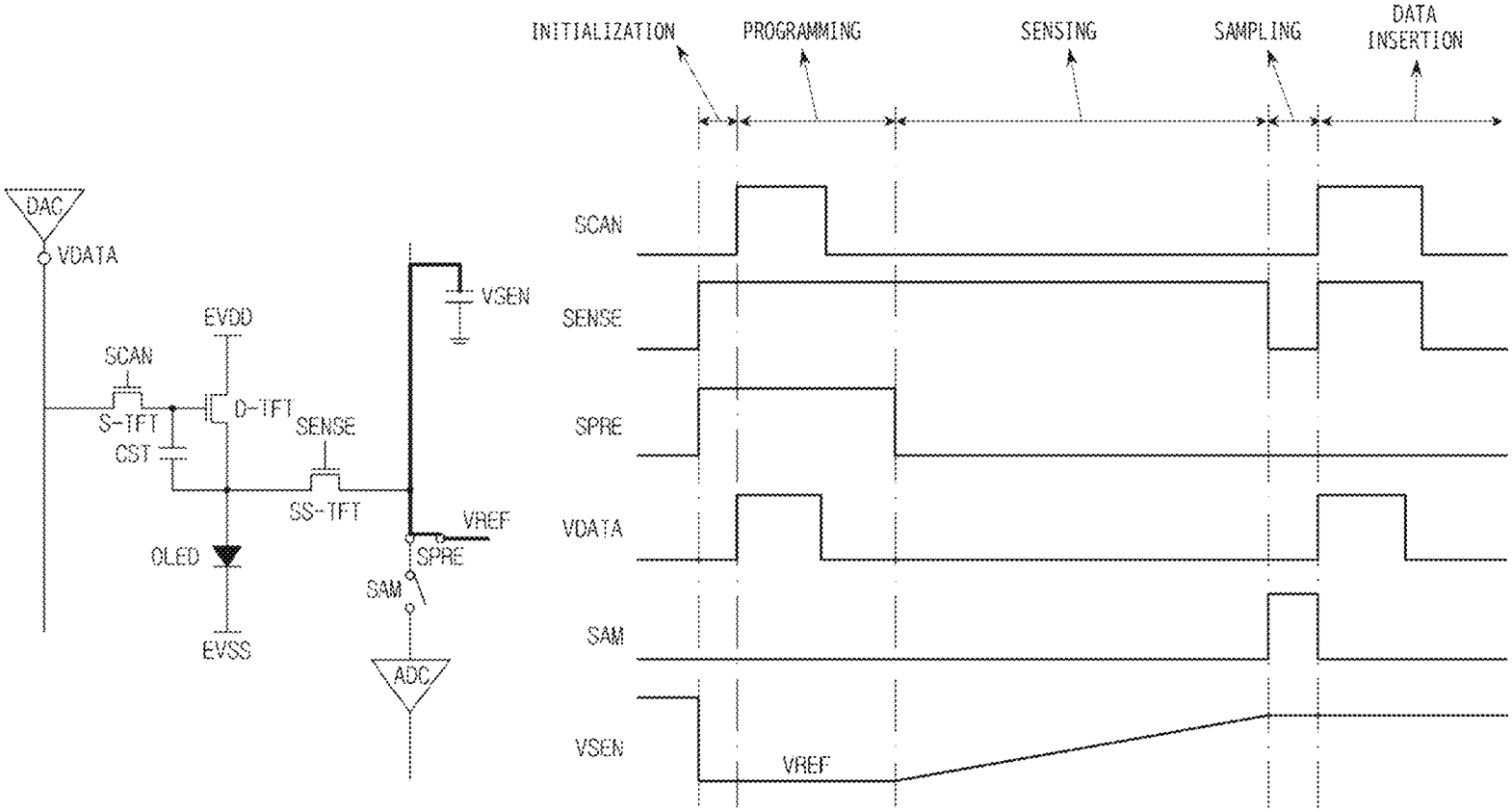
FIGS. 4 to 8 are views illustrating an example compensation for a mobility characteristic while the display device according to an example embodiment of the present disclosure is driven.

As illustrated in FIG. 4, the switch SPRE may be turned on in an initialization period. Accordingly, the sensing voltage VSEN stored in the capacitor of the reference line may be equal to the reference voltage VREF.

Figure 5:
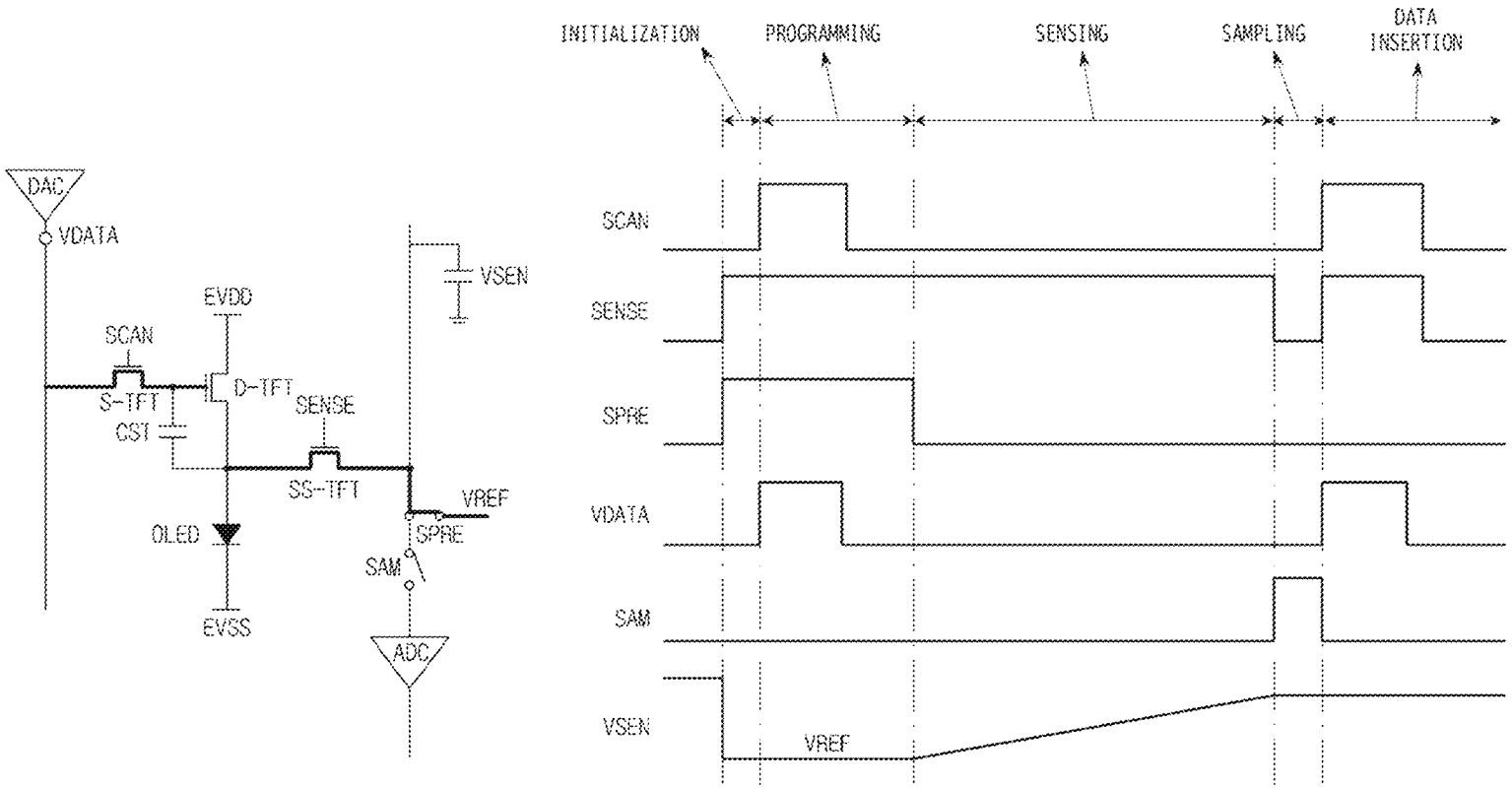

As illustrated in FIG. 5, the scan TFT (S-TFT) may be turned on in a programming period. In addition, the data voltage VDATA may be a high voltage. Accordingly, a charge corresponding to the data voltage VDATA may be charged at one electrode of the storage capacitor CST. In addition, in the programming period, the sensing TFT (SS-TFT) may be turned on, and the switch SPRE may be turned on. Accordingly, the other electrode of the storage capacitor CST may be charged with a charge corresponding to the reference voltage VREF. That is, the voltage across the storage capacitor CST may correspond to a difference between the data voltage VDATA and the reference voltage VREF. Meanwhile, as the switch SPRE is maintained on in this period, the sensing voltage VSEN may be maintained at the reference voltage VREF.

Figure 6:
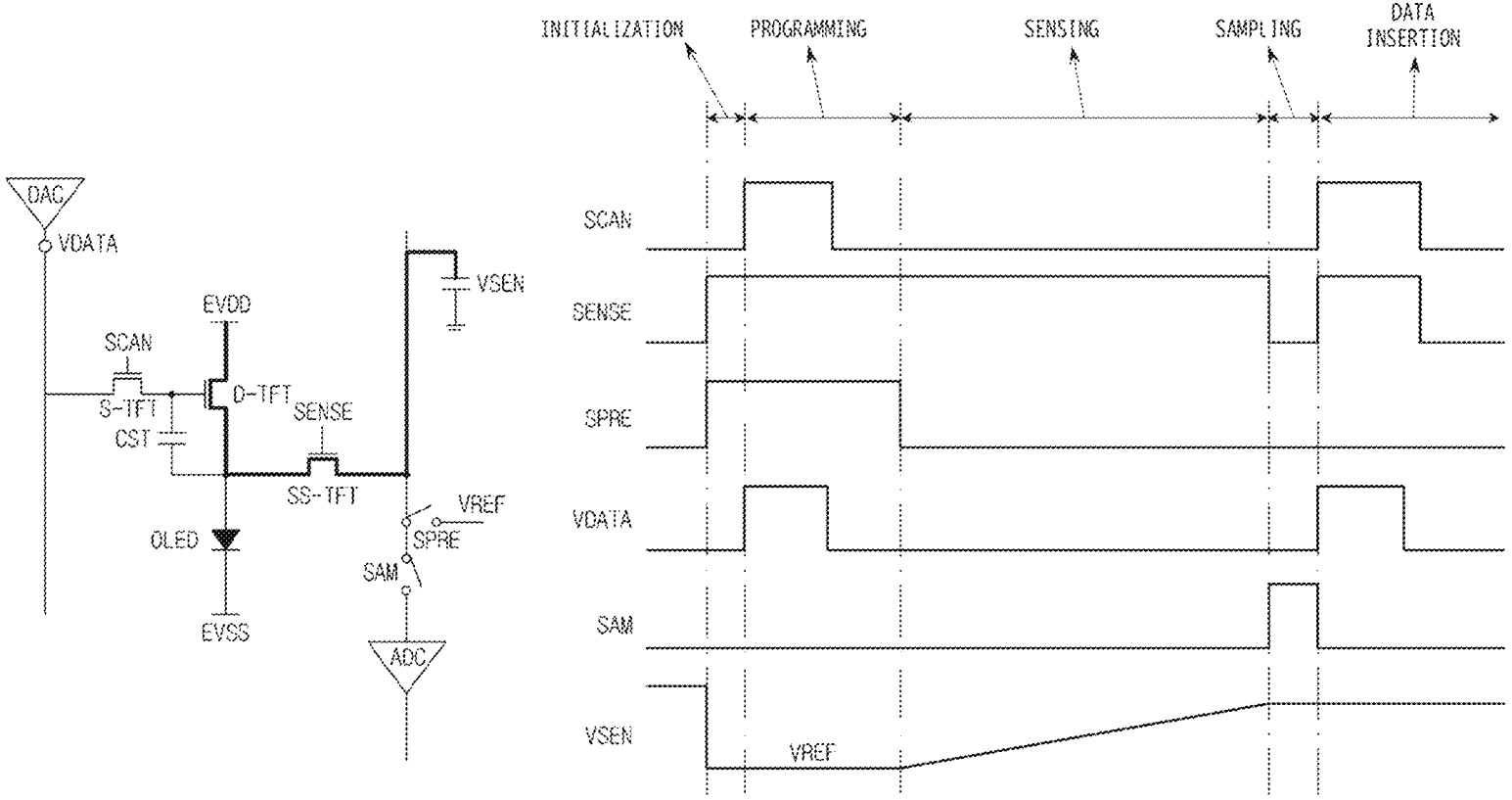

As illustrated in FIG. 6, in a sensing period, the scan TFT (S-TFT) may be turned off, and the sensing TFT (SS-TFT) may be turned on. Accordingly, the driving TFT (D-TFT) may operate like a constant current source with a constant magnitude, and the current may be applied to the reference line capacitor through the sensing TFT (SS-TFT). Accordingly, the sensing voltage VSEN may increase with a constant voltage increase over time.

Figure 7:
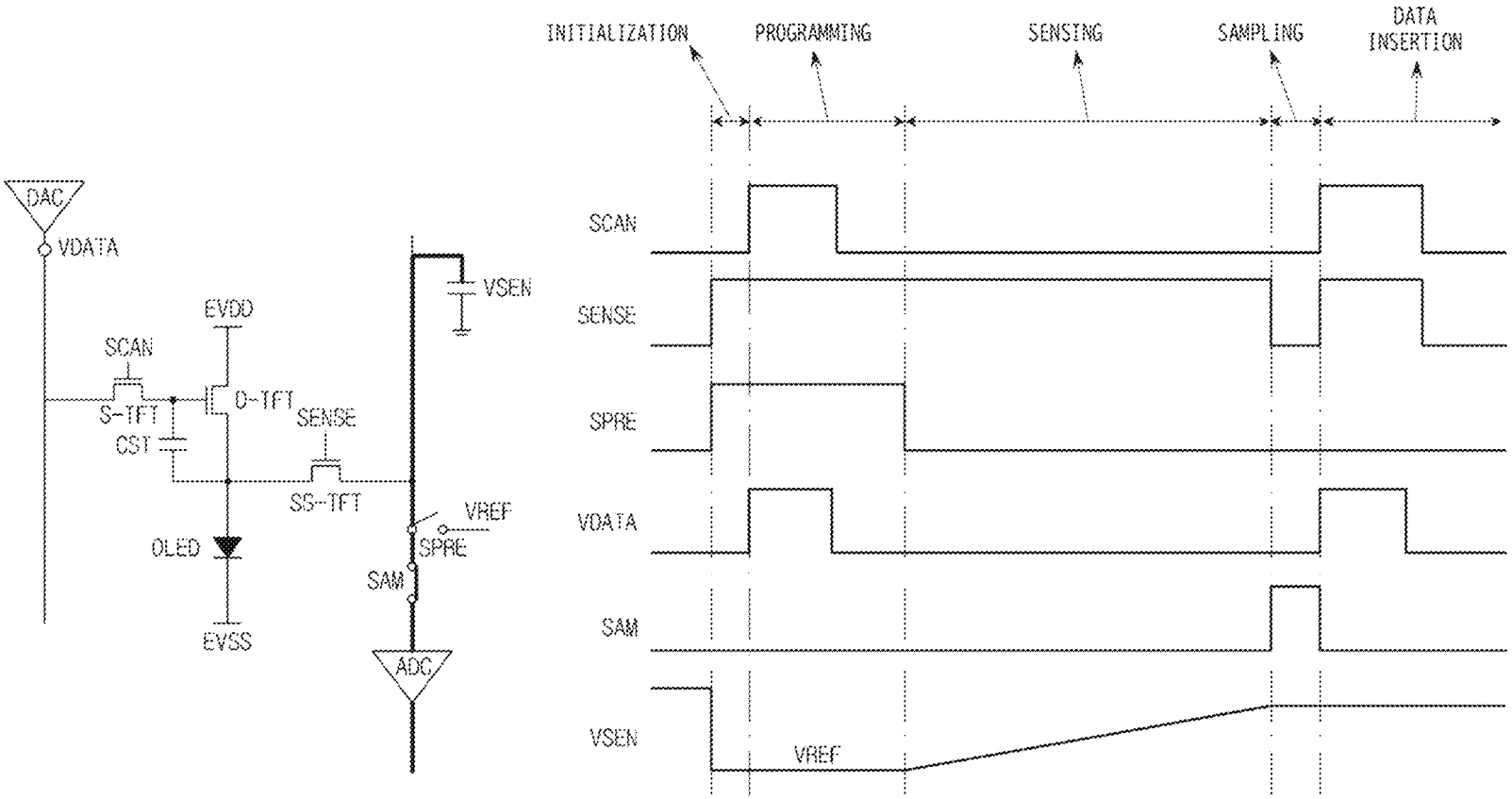

As illustrated in FIG. 7, in a sampling period, the sensing TFT (SS-TFT) may be turned off, and another switch SAM may be turned on. Accordingly, the sensing voltage VSEN may be applied to the source driving IC (S-IC) via the ADC through the reference line REFERENCE. The source driving IC (S-IC) to which the sensing voltage VSEN is applied may calculate the mobility characteristic of the corresponding driving TFT (D-TFT).

Figure 8:
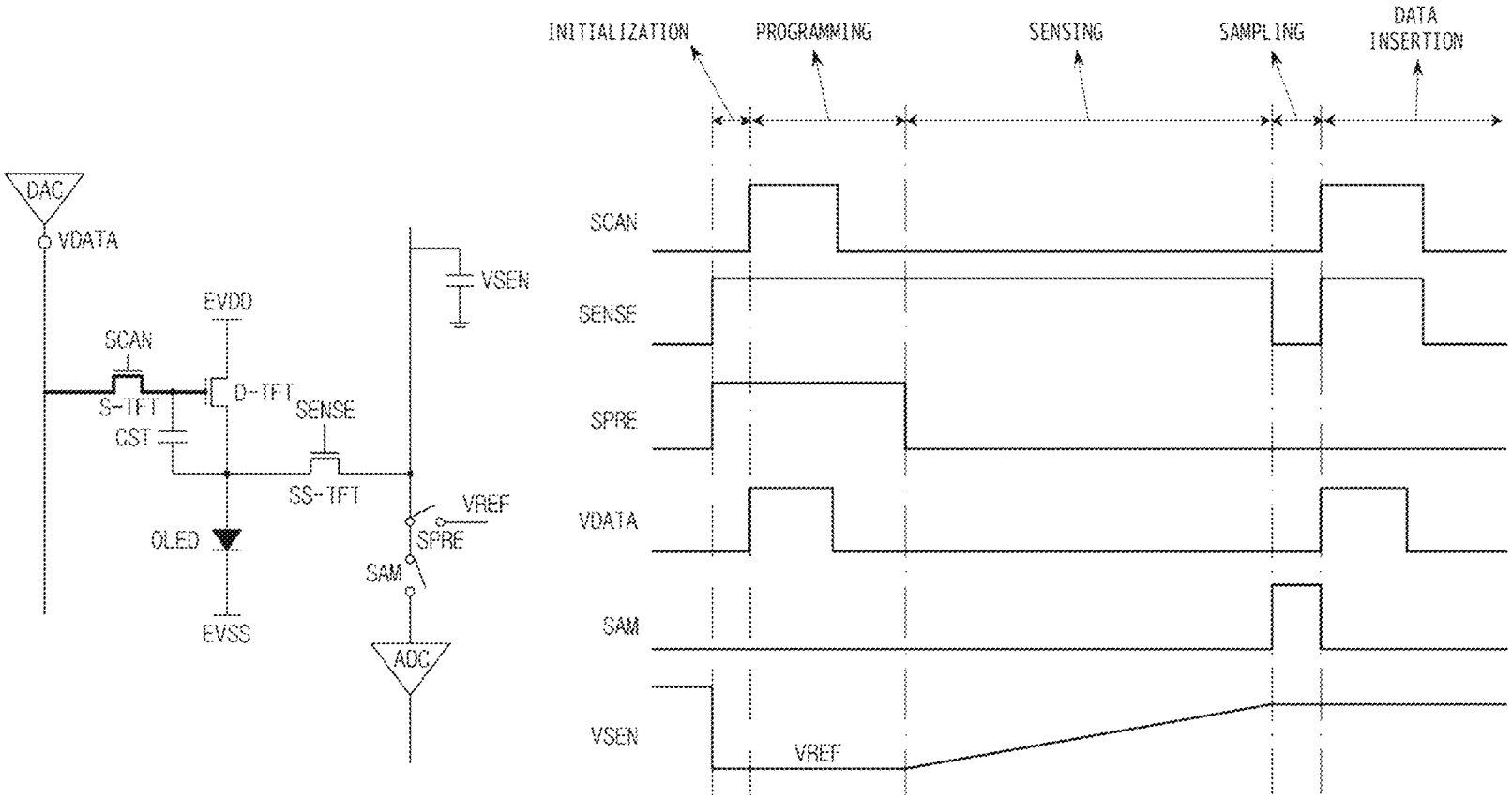

As illustrated in FIG. 8, in a data insertion period after the sampling period, the scan TFT (S-TFT) may be turned on, and the data voltage VDATA may be a high voltage. That is, as the real-time compensation is performed, the example process of FIGS. 4 to 8 may be performed during the blank period between two successive frames. Therefore, a luminance deviation from another data line charged with an existing data voltage may occur. In order to correct the potential luminance deviation, the data of the previous frame may be restored after the sampling period.

Figure 9:
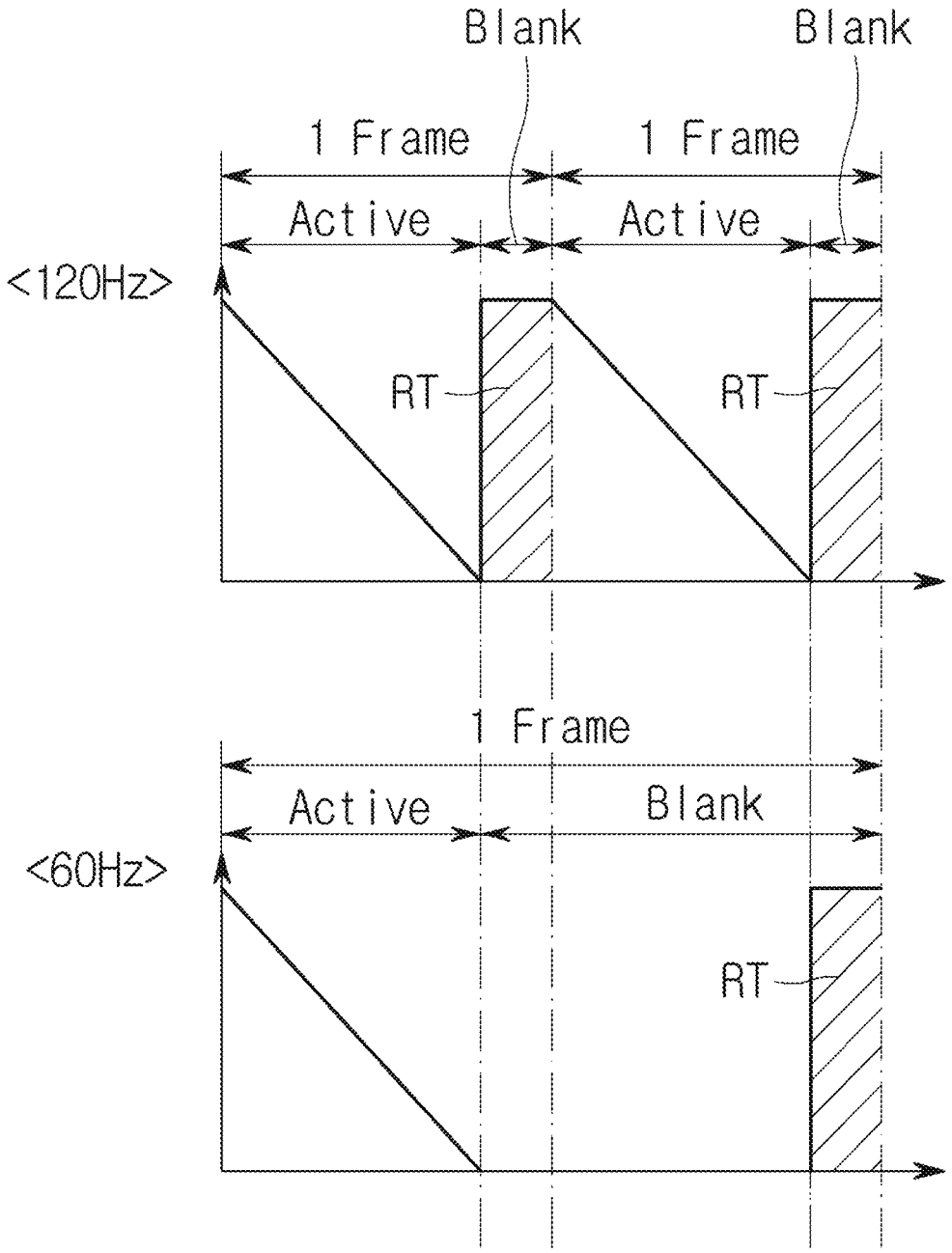
FIG. 9 is a view illustrating one frame of both a high speed driving mode and a low speed driving mode according to an example embodiment of the present disclosure.

FIG. 9 is a view illustrating one frame of both a high speed driving mode and a low speed driving mode according to an example embodiment of the present disclosure.

One frame period refers to a period in which one frame of image is output. During one frame period, one frame of image may be displayed through the display panel 50. For example, in the event that a driving frequency is 120 Hz, 120 image frames per second may be displayed through the display panel 50. In the event that the driving frequency is 60 Hz, 60 image frames per second may be displayed through the display panel 50.

In an example embodiment, in the event that images different from each other are displayed through the display panel 50 during multiple frame periods, a video image may be displayed. In the event that the same image is displayed during multiple frame periods, a still image may be displayed. When the image data is a video image, the display device 1 may be driven in the high speed driving mode. When the image data is a still image, the display device 1 may be driven in the low speed driving mode. In the FIG. 9 example, the high speed driving mode and the low speed driving mode are described as the 120 Hz driving frequency and the 60 Hz driving frequency, respectively.

In other words, in this example embodiment, a frame rate in the high speed driving mode is 120 Hz, which is referred to as a first frame rate in the present specification. In addition, a frame rate in the low speed driving mode in this example is 60 Hz, which is referred to as a second frame rate in the present specification. However, the present disclosure is not limited thereto.

As illustrated in FIG. 9 with reference FIGS. 1 to 8, one frame of the high speed driving mode and one frame of the low speed driving mode may each include an active period and a vertical blank period. In an example embodiment of the present disclosure, a sensing period for sensing the mobility characteristic of the driving TFT may be included within the blank period.

Specifically, in the first frame rate (e.g., 120 Hz), the active period may be determined as a first active period, the blank period may be determined as a first blank period, and the sensing period may be determined as a first sensing period. In addition, in the second frame rate (e.g., 60 Hz), the active period may be determined as a second active period, the blank period may be determined as a second blank period, and the sensing period may be determined as a second sensing period.

For example, the first active period in the example 120 Hz high speed driving mode may be 8.33 milliseconds (ms), the first blank period may be 300 microseconds (μs), and the first sensing period may be the same as or shorter than the first blank period. Therefore, a total sum of the 120 frame periods may be 1 second. In addition, the second active period in the example 60 Hz low speed driving mode may be 8.33 ms, the second blank period may be 8.33 ms+600 μs, and the second sensing period may be the same as the first sensing period at 300 μs or shorter.

That is, according to an example embodiment of the present disclosure, when the frame rate is changed from the high speed driving mode to the low speed driving mode, the first active period and the second active period may be determined to be the same. In addition, the second blank period may be determined to be longer than the first blank period. Specifically, the second blank period may be determined to be a sum of the first active period and two first blank periods. In addition, the second sensing period may be determined to be the same as the first sensing period.

As described above, the first frame rate (e.g., 120 Hz) may be greater than the second frame rate (e.g., 60 Hz). When the display device 1 is operated in the first frame rate, the first active period, the first blank period, and the first sensing period may be determined. For example, as illustrated in FIG. 9, in the high speed driving mode with the example first frame rate of 120 Hz, one frame period may include one first active period and one first blank period, and the first sensing period may be included in the first blank period. In addition, as illustrated FIG. 9, in the low speed driving mode with the example second frame rate of 60 Hz, one frame period may include one second active period and one second blank period, and the second sensing period may be included in the second blank period. That is, two frames in driving at the first frame rate (e.g., 120 Hz) may be as long as one frame in driving at the second frame rate (e.g., 60 Hz).

According to an example embodiment of the present disclosure, the first sensing period and the second sensing period may be the same. In addition, the first active period may be the same as the second active period. As a result, the second blank period may be longer than the first blank period.

In addition, as illustrated in FIG. 9, an ending time of the second sensing period may be the same as an ending of the second blank period. In other words, the ending time of the second sensing period may be the same as an ending time of the frame at the second frame rate.

Furthermore, a starting time of the second sensing period may be after an ending time of the second active period (the second blank period—the second sensing period). In other words, the starting time of the second sensing period may be a time calculated with the second sensing period backwards from the ending time of one frame at the second frame rate.

However, the first frame period, the first active period, the first blank period, the first sensing period, the second frame period, the second active period, the second blank period, and the second sensing period that are as described above may be stored as parameters in the memory of the display device according to an example embodiment of the present disclosure. Depending on the frame rate determined by an input control command, the display device may perform the driving according to the frame period, the active period, the blank period, and the sensing period that depend on the frame rate determined by referencing the parameters.

More specifically, during the active period, the gate driver 20 and the data driver 30 may sequentially scan the pixels PX according to a control of the timing controller 10, and the image data may be supplied to each subpixel. According to the control of the timing controller 10, during the sensing period of the blank period, the gate driver 20 and the data driver 30 may select any sensing line and may perform the real-time compensation.

In the present disclosure, as one example method for reducing a power consumption of the display device 1, a variable refresh rate (VRR) driving mode that outputs an image by changing the driving frequency may be used. The VRR driving mode refers to an example driving manner of driving the display device 1. In the VRR driving mode, an image having a relatively large gray scale change may be driven at the high speed driving mode of which the driving frequency is 120 Hz, and an image having a relatively small gray scale change may be driven at the low speed driving mode of which the driving frequency is 60 Hz. As illustrated in FIG. 9, in comparison between the high speed driving mode and the low speed driving mode, the active period of one frame is the same in both of the driving modes. However, the blank period of one frame in the low speed driving mode may be longer than the blank period of one frame in the high speed driving mode.

In a display device in a conventional VRR driving mode in which the driving mode is changed between the high speed driving mode and the low speed driving mode according to an image data, a deviation in recovery data may occur since the real-time compensation is performed at the beginning of the blank period. The recovery data may include an image data before the sensing and a compensation value to compensate for luminance that is relatively reduced by a real-time sensing operation. In particular, the compensation value of the recovery data may include a compensation value to compensate for a difference in charging time of the image data and a difference in charging time of the recovery data.

In other words, during an operation of the VRR driving mode in which the frame rate is changed, the blank period of the low speed driving mode may be longer than the blank period of the high speed driving mode. In that event, the charging time of the recovery data in the low speed driving mode ends up being longer than the charging time of the recovery data in the high speed driving mode. Accordingly, in the conventional display device, the memory allocation for resetting a lookup table and the like according to a frame rate change may be necessary.

In order to solve this problem, in the display device 1 according to an example embodiment of the present disclosure, when the frame rate is changed from the high speed driving mode to the low speed driving mode, a sensing time may be determined so that the lookup table and the like are not reset by the VRR mode driving.

Figure 10:
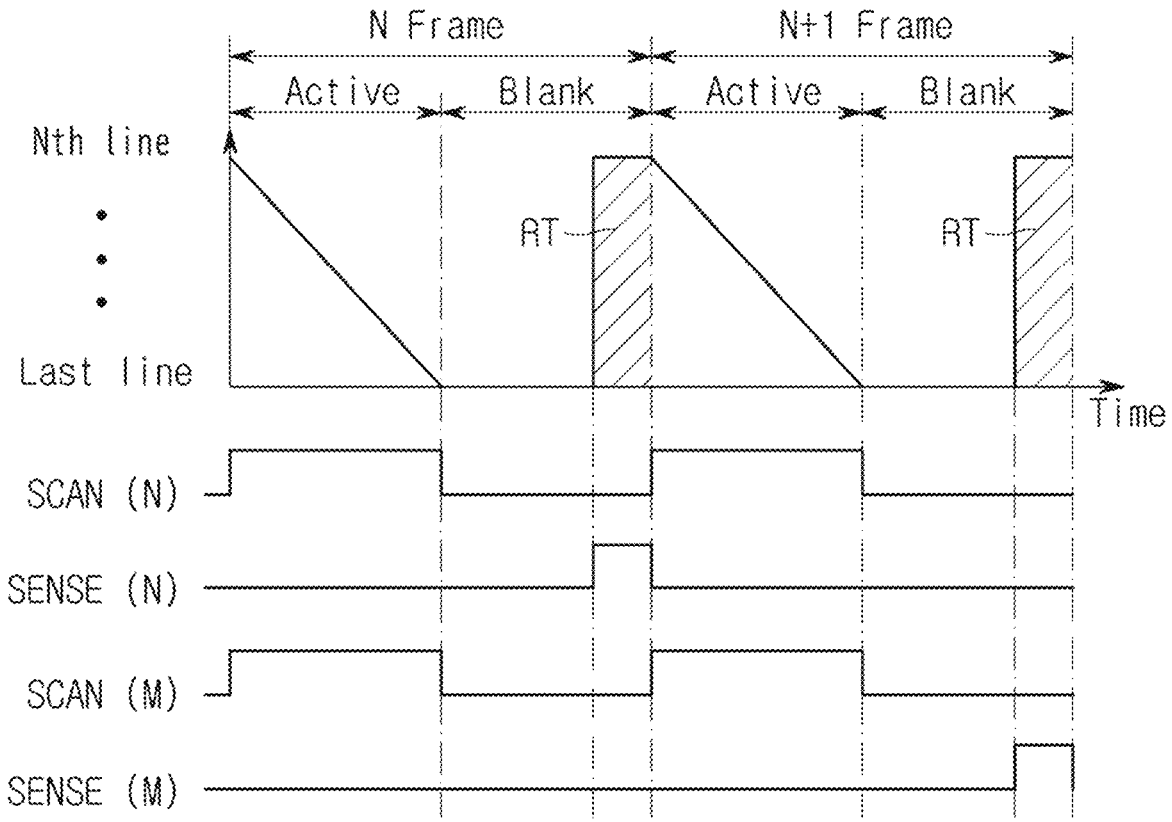
FIG. 10 is a timing chart illustrating a real-time compensation method of the display device according to a first example embodiment when a frame rate is changed from the high speed driving mode to the low speed driving mode.

FIG. 10 is a timing chart illustrating a real-time compensation method of the display device according to a first example embodiment when a frame rate is changed from the high speed driving mode to the low speed driving mode.

As illustrated in FIG. 10 with reference FIGS. 1 to 9, depending on the control of the timing controller 10, the gate driver 20 and the data driver 30 may select a sensing line (e.g., N or M) during the blank period of one frame and may perform the real-time compensation for the selected sensing line during the sensing period, and may restore the previous image data display state for the sensing line on which the real-time compensation operation is performed during the data insertion period.

Each frame (N and N+1) in the low speed driving mode may include an active period and a blank period. In an example embodiment, a sensing period for sensing the mobility characteristic of the driving TFT may be included within the blank period. Specifically, in the low speed driving mode, the active period may refer to the second active period, the blank period may refer to the second blank period, and the sensing period may refer to the second sensing period.

As shown in FIG. 10, the real-time compensation for an Nth sensing line may be performed during the second sensing period of the Nth frame, and the real-time compensation for an Mth sensing line may be performed during the second sensing period of the N+1th frame. On the display panel 50, the Mth line may be positioned closest to the Nth line in a pixel column direction.

In an example embodiment, when the driving mode is changed between the high speed driving mode and the low speed driving mode, the ending time of the second sensing period of the low speed driving mode may be determined to be the same as the ending time of the second blank period in order to reduce the deviation of recovery data between both the two driving modes. Specifically, in one frame period of the low speed driving mode, both the scan TFT (S-TFT) and the sensing TFT (SS-TFT) may be turned off at the initialization period in which the second blank period starts after the second active period. Further, only the sensing TFT (SS-TFT) may be turned on at the second sensing period of the second blank period before one frame period ends. Accordingly, in the VRR driving mode, the respective recovery data in the high speed driving mode and the low speed driving mode may be maintained to be the same, so that the resetting of the lookup table and the like becomes unnecessary.

Figure 11:
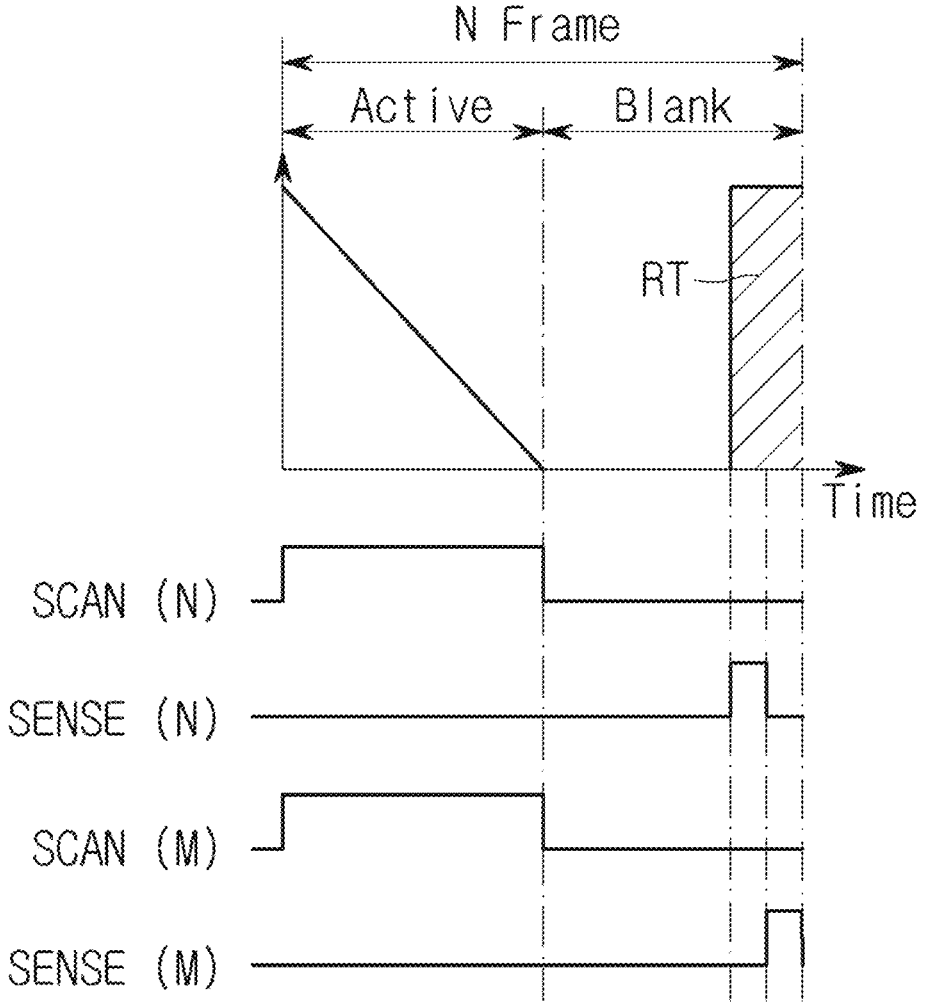
FIG. 11 is a timing chart illustrating the real-time compensation method of the display device according to a second example embodiment when the frame rate is changed from the high speed driving mode to the low speed driving mode.

FIG. 11 is a timing chart illustrating the real-time compensation method of the display device according to a second example embodiment when the frame rate is changed from the high speed driving mode to the low speed driving mode.

As illustrated in FIG. 11 with reference FIGS. 1 to 9, depending on the control of the timing controller 10, the gate driver 20 and the data driver 30 may simultaneously select multiple sensing lines (e.g., N and M) during the blank period of the Nth frame, and may sequentially perform the real-time compensation for the selected sensing lines during the sensing period of the blank period. After performing the sensing operation, the previous image data display state may be restored for the multiple sensing lines (N and M) during the data insertion period.

The Nth frame in the low speed driving mode may include the active period and the blank period. In an example embodiment, the sensing period for sensing the mobility characteristic of the driving TFT may be included within the blank period. Specifically, in the low speed driving mode, the active period may refer to the second active period, the blank period may refer to the second blank period, and the sensing period may refer to the second sensing period.

In comparison to the first embodiment, in the second embodiment, both the real-time compensation of the Nth sensing line and the real-time compensation of the Mth sensing line may be performed during the second blank period of the Nth frame. The Nth sensing line and the Mth sensing line may be disposed closest to each other in the pixel column direction on the display panel 50 or may be spaced farther apart from each other in the pixel column direction with one or more sensing lines between them.

In an example embodiment, when the driving mode is changed between the high speed driving mode and the low speed driving mode, the ending time of the second sensing period of the low speed driving mode may be determined to be the same as the ending time of the second blank period in order to reduce the deviation of recovery data between the two driving modes. Specifically, in the Nth frame period in the low speed driving mode, all of the scan TFT (S-TFT) and sensing TFT (SS-TFT) on the Nth line and the Mth line may be turned off in the initialization period in which the second blank period starts after the second active period. Further, in the second sensing period of the second blank period before the Nth frame period ends, the sensing TFT (SS-TFT) of the Nth sensing line and the sensing TFT (SS-TFT) of the Mth sensing line may be sequentially turned on. That is, according to the second example embodiment, by sequentially performing the real-time compensation of the Nth sensing line and the Mth sensing line within the second sensing period of the Nth frame period, the overall sensing time of the display panel 50 may be reduced.

Although the performing of the real-time sensing of the Nth sensing line and the Mth sensing line is described above as an example, the present embodiment is not limited thereto.

Figure 12:
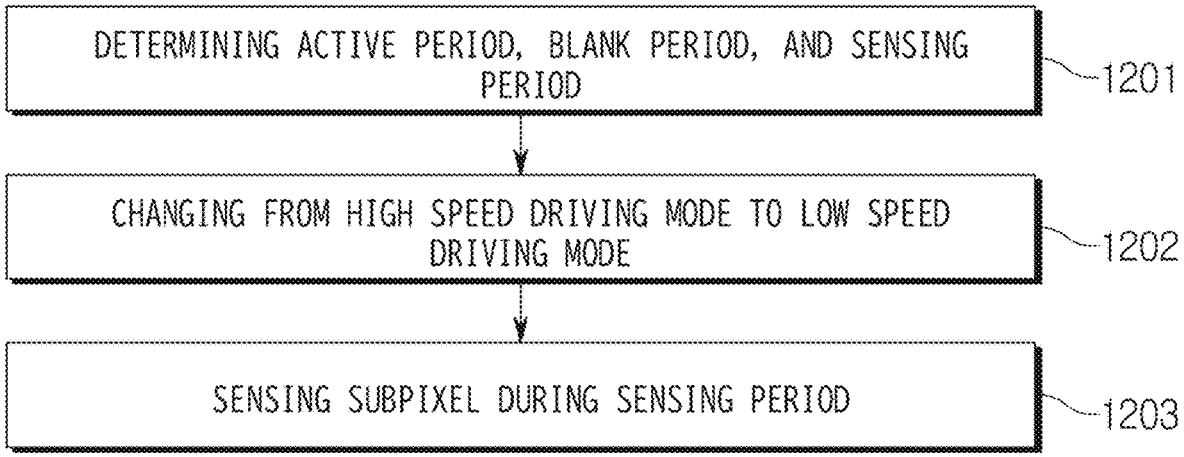
FIG. 12 is a flow chart illustrating the real-time compensation method when a driving mode of the display device according to an example embodiment of the present disclosure is changed.

FIG. 12 is a flow chart illustrating a real-time compensation method when a driving mode of the display device according to an example embodiment of the present disclosure is changed.

As illustrated FIG. 12 with reference FIGS. 1 to 9, in operation 1201, the timing controller 10 may determine the frame rate as the high speed driving mode or the low speed driving mode based on the image data output from the display panel 50. One frame period of each of the high speed driving mode and the low speed driving mode may include the active period and the vertical blank period. The sensing period for sensing the mobility characteristic of the driving TFT may be included within the blank period.

Specifically, in the first frame rate (e.g., 120 Hz) that is the high speed driving mode, the active period may be determined as the first active period, the blank period may be determined as the first blank period, and the sensing period may be determined as the first sensing period. In addition, in the second frame rate (e.g., 60 Hz) of the low speed driving mode, the active period may be determined as the second active period, the blank period may be determined as the second blank period, and the sensing period may be determined as the second sensing period.

For example, the first active period in the example 120 Hz high speed driving mode may be 8.33 ms, the first blank period may be 300 μs, and the first sensing period may be the same as or shorter than the first blank period. Therefore, sum of a total of 120 frame periods may be 1 second. In addition, the second active period in the example 60 Hz low speed driving mode may be 8.33 ms, the second blank period may be 8.33 ms+600 μs, and the second sensing period may be the same as the first sensing period at 300 us or shorter.

That is, according to example embodiments of the present disclosure, when the frame rate is changed between the high speed driving mode and the low speed driving mode, the first active period (corresponding to the high speed driving mode) and the second active period (corresponding to the low speed driving mode) may be determined to be the same. In addition, the second blank period (corresponding to the low speed driving mode) may be determined to be longer than the first blank period (corresponding to the high speed driving mode). Specifically, the second blank period may be determined to be a sum of the first active period and two first blank periods. In addition, the second sensing period (corresponding to the low speed driving mode) may be determined to be the same as the first sensing period (corresponding to the high speed driving mode).

More specifically, during the active period, depending on the control of the timing controller 10, the gate driver 20 and the data driver 30 may sequentially scan the pixels PX and the image data may be supplied to each subpixel. Depending on the control of the timing controller 10, during the sensing period of the blank period that will be described later, the gate driver 20 and the data driver 30 may select one or more sensing lines and may perform the real-time compensation.

In operation 1202, when outputting an image data having a relatively small gray scale change, the timing controller 10 may change the driving mode of the gate driver 20 and the data driver 30 from the high speed driving mode to the low speed driving mode. That is, the timing controller 10 may change the driving frequency so as to reduce the power consumption of the display device 1. The high speed driving mode and the low speed driving mode may have the same active period in one frame, but the blank period within one frame in the low speed driving mode may be longer than the blank period within one frame in the high speed driving mode.

In operation 1203, the subpixel(s) connected to the sensing line may be sensed during the sensing period in the low speed driving mode. In this case, the sensing period of the low speed driving mode may be maintained to be the same as the sensing period of the high speed driving mode. That is, the ending time of the sensing period of the low speed driving mode may be maintained to be the same as the ending time of the sensing period of the high speed driving mode. Further, in the low speed driving mode, the ending time of the sensing period may be the same as the ending time of the blank period.

Therefore, even if the driving mode of the display device 1 is changed between the high speed driving mode and the low speed driving mode, the memory allocation for data resetting may be unnecessary.

It will be understood by those skilled in the art that the present disclosure can be embodied in other specific forms without changing the technical idea or essential characteristics of the present disclosure. Therefore, it should be understood that the embodiments described above are illustrative in all aspects and not restrictive. The scope of the present disclosure is characterized by the appended claims rather than the detailed description described above, and it should be construed that all alterations or modifications derived from the meaning and scope of the appended claims and the equivalents thereof fall within the scope of the present disclosure.

The example embodiments described above are intended to be illustrative in all aspects and not restrictive. It will be apparent to those skilled in the art that various substitutions, modifications, and variations are possible within the scope of the present disclosure without departing from the spirit and scope of the present disclosure. Therefore, it is intended that embodiments of the present disclosure cover the various substitutions, modifications, and variations of the present disclosure, provided they come within the scope of the appended claims and their equivalents.

What is claimed is:

1. A display device, comprising:

a display panel comprising a plurality of subpixels connected respectively to a plurality of scan lines, a plurality of sensing lines, and a plurality of data lines, the display panel being capable of operating at a first frame rate and at a second frame rate different from the first frame rate;

a gate driver configured to supply a scan signal to the scan lines during an active period of one frame and configured to supply a sensing signal to the sensing lines during a sensing period of a blank period of the one frame;

a data driver configured to supply a data voltage to the data lines; and a timing controller configured to control the gate driver and the data driver, the timing controller being configured to determine the active period, the blank period, and the sensing period to be, respectively:

a first active period, a first blank period, and a first sensing period for operating the display panel at the first frame rate; and a second active period, a second blank period, and a second sensing period for operating the display panel at the second frame rate, wherein the first sensing period and the second sensing period have a same length, wherein the first frame rate is greater than the second frame rate, and the first active period has a same length as the second active period, wherein the second blank period is longer than the first blank period, and wherein the timing controller is configured to determine a starting time of the second sensing period by calculating backwards from an ending time of the one frame at the second frame rate by a length of the second sensing period.

2. The display device of claim 1, wherein an ending time of the second sensing period is concurrent with an ending time of the second blank period.

3. The display device of claim 1, wherein, with a change from an operation at the first frame rate to an operation at the second frame rate, the timing controller is configured to select at least one of the sensing lines during the second blank period, and the gate driver is configured to supply the sensing signal to the at least one selected sensing line during the second sensing period.

4. The display device of claim 1, wherein, with a change from an operation at the first frame rate to an operation at the second frame rate, the timing controller is configured to select two or more of the sensing lines during the second blank period, and the gate driver is configured to supply the sensing signal to the two or more selected sensing lines sequentially during the second sensing period.

5. The display device of claim 4, wherein the two or more selected sensing lines are adjacent to each other on the display panel in a pixel column direction.

6. The display device of claim 1, further comprising a memory configured to store one or more of the first active period, the first blank period, the first sensing period, the second active period, the second blank period, and the second sensing period as parameters.

7. The display device of claim 1, wherein the timing controller is configured to control the gate driver and the data driver based on:

the first active period, the first blank period, the first sensing period during an operation of the display panel at the first frame rate, and the second active period, the second blank period, and the second sensing period during an operation of the display panel at the second frame rate.

8. The display device of claim 1, wherein each of the subpixels includes a driving transistor connected to a corresponding one of the sensing lines, and wherein the gate driver is configured to supply the sensing signal to the corresponding one of the sensing lines to sense one or more of a mobility characteristic and a threshold voltage of the driving transistor.

9. A compensation method for a display device comprising a display panel with a plurality of subpixels connected respectively to a plurality of scan lines, the display panel being capable of operating at a first frame rate and at a second frame rate different from the first frame rate, the method comprising:

determining a frame rate as the first frame rate or the second frame rate based on an image data provided to the display panel;

determining an active period, a blank period, and a sensing period of one frame to be, respectively:

a first active period, a first blank period, and a first sensing period if the determined frame rate is the first frame rate, and a second active period, a second blank period, and a second sensing period if the determined frame rate is the second frame rate, the first sensing period and the second sensing period having a same length;

changing the frame rate from the first frame rate to the second frame rate; and applying a sensing signal to at least one of the sensing lines to sense at least corresponding one of the subpixels connected to the at least one of the sensing lines during the second sensing period, wherein the first frame rate is greater than the second frame rate, and the first active period has a same length as the second active period, wherein the second blank period is longer than the first blank period, and wherein the applying of the sensing signal comprises:

determining a starting time of the second sensing period by determining backwards from an ending time of the one frame at the second frame rate by a length of the second sensing period; and starting the second sensing period at the determined starting time.

10. The method of claim 9, wherein an ending time of the second sensing period is concurrent with an ending time of the second blank period.

11. The method of claim 9, wherein the applying of the sensing signal comprises:

selecting the at least one of the sensing lines during the second blank period; and supplying the sensing signal to the at least corresponding one of the subpixels during the second sensing period to sense one or more of a mobility characteristic and a threshold voltage of a driving transistor of the at least corresponding one of the subpixels.

12. The method of claim 9, wherein the applying of the sensing signal comprises:

selecting two or more of the sensing lines during the second blank period; and supplying the sensing signal to the two or more selected sensing lines sequentially during the second sensing period to sense a characteristic value of corresponding subpixels among the plurality of subpixels connected to the two or more selected sensing lines.

13. The method of claim 12, wherein the two or more sensing lines are adjacent to each other on the display panel in a pixel column direction.

14. The method of claim 9, wherein the display device further comprises a memory, and wherein one or more of the first active period, the first blank period, the first sensing period, the second active period, the second blank period, and the second sensing period are stored as parameters in the memory.

* * * * *